US011761676B2

(12) United States Patent
Otsuka et al.

(10) Patent No.: US 11,761,676 B2
(45) Date of Patent: Sep. 19, 2023

(54) OUTDOOR UNIT OF AIR-CONDITIONING APPARATUS

(71) Applicant: Mitsubishi Electric Corporation, Tokyo (JP)

(72) Inventors: Motoki Otsuka, Tokyo (JP); Noka Sakabe, Tokyo (JP); Mizuo Sakai, Tokyo (JP); Tetsuya Yamashita, Tokyo (JP); Masafumi Tomita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 507 days.

(21) Appl. No.: 16/770,992

(22) PCT Filed: Jan. 30, 2018

(86) PCT No.: PCT/JP2018/002810
§ 371 (c)(1),
(2) Date: Jun. 9, 2020

(87) PCT Pub. No.: WO2019/150410
PCT Pub. Date: Aug. 8, 2019

(65) Prior Publication Data
US 2020/0333040 A1 Oct. 22, 2020

(51) Int. Cl.
*F24F 13/24* (2006.01)
*F24F 13/20* (2006.01)
(Continued)

(52) U.S. Cl.
CPC ..... *F24F 13/24* (2013.01); *F04B 39/0033* (2013.01); *F04B 53/002* (2013.01);
(Continued)

(58) Field of Classification Search
CPC ..... F24F 1/10; F24F 1/12; F24F 1/22; F24F 1/40; F24F 1/56; F24F 11/88; F24F 13/20;
(Continued)

(56) References Cited

U.S. PATENT DOCUMENTS 5,151,018 A * 9/1992 Clendenin ..... F04B 39/0033 417/313
8,136,626 B1 * 3/2012 Aliev ..... E04H 15/14 181/208
(Continued)

FOREIGN PATENT DOCUMENTS

JP H02-124281 U 10/1990
JP 2006-161703 A 6/2006
(Continued)

OTHER PUBLICATIONS

Thermaxx, Noise Insulation Jackets, Dec. 11, 2017, Retrieved from https://web.archive.org/web/20171211064838/https://www.thermaxxjackets.com/products/noise-sound-insulation/ (Year: 2017).*
(Continued)

*Primary Examiner* — Jerry-Daryl Fletcher
*Assistant Examiner* — Daniel C Comings
(74) *Attorney, Agent, or Firm* — POSZ LAW GROUP, PLC

(57) ABSTRACT

An outdoor unit of an air-conditioning apparatus includes: a terminal unit that is provided on an outer peripheral surface of a compressor, and electrically connects components provided in the compressor and outside the compressor; a side soundproof cover that covers the outer peripheral surface of the compressor except for the terminal unit; and a terminal cover that covers the terminal unit exposed from the side soundproof cover to the outside of the side soundproof cover, and soundproofs the terminal unit. The terminal cover
(Continued)

is attached to the side soundproof cover such that the state of the terminal cover can be changed between a state in which the terminal cover covers the terminal unit and a state in which the terminal cover does not cover the terminal unit.

8 Claims, 8 Drawing Sheets

(51) Int. Cl.

| | |
|---|---|
| ***F24F 11/88*** | (2018.01) |
| ***F24F 1/10*** | (2011.01) |
| ***F24F 1/12*** | (2011.01) |
| ***F24F 1/22*** | (2011.01) |
| ***F24F 1/40*** | (2011.01) |
| ***F24F 1/56*** | (2011.01) |
| ***F04C 29/06*** | (2006.01) |
| ***F04B 53/00*** | (2006.01) |
| ***F04B 39/00*** | (2006.01) |

(52) U.S. Cl.
CPC ..... *F04C 29/063* (2013.01); *F24F 1/10* (2013.01); *F24F 1/12* (2013.01); *F24F 1/22* (2013.01); *F24F 1/40* (2013.01); *F24F 1/56* (2013.01); *F24F 11/88* (2018.01); *F24F 13/20* (2013.01); *F24F 2013/202* (2013.01); *F24F 2013/242* (2013.01)

(58) Field of Classification Search
CPC ..... F24F 13/24; F24F 2013/202; F24F 2013/242; F04B 39/0027; F04B 39/0033; F04B 53/001; F04B 53/002
See application file for complete search history.

(56) References Cited

U.S. PATENT DOCUMENTS

| | | | | |
|---|---|---|---|---|
| 9,063,405 | B2 * | 6/2015 | Clawson | F04D 25/084 |
| 2020/0224898 | A1 * | 7/2020 | Zambolin | F24F 13/0245 |

FOREIGN PATENT DOCUMENTS

| | | | | |
|---|---|---|---|---|
| JP | 2013-124783 | A | | 6/2013 |
| JP | 2013124783 | A | * | 6/2013 |
| JP | 2015-135104 | A | | 7/2015 |
| JP | 2015135104 | A | * | 7/2015 |
| JP | 2017-156038 | A | | 9/2017 |

OTHER PUBLICATIONS

The Cutting Class, Fundamentals of Pattern Making: Pattern Notches, Aug. 30, 2012, https://www.thecuttingclass.com/pattern-notches-alexander-wang/ (Year: 2012).*

International Search Report of the International Searching Authority dated Apr. 10, 2018 in corresponding International Patent Application No. PCT/JP2018/002810 (and English translation).

Chinese Office Action dated Mar. 18, 2021, issued in corresponding Chinese Patent Application No. 201880087525.X (and English Machine Translation).

Japanese Office Action dated Feb. 9, 2021, issued in corresponding JP Patent Application No. 2019-568842 (and English Machine Translation).

* cited by examiner

OUTDOOR UNIT OF AIR-CONDITIONING APPARATUS

CROSS REFERENCE TO RELATED APPLICATION

This application is a U.S. national stage application of PCT/JP2018/002810 filed on Jan. 30, 2018, the contents of which are incorporated herein by reference.

TECHNICAL FIELD

The present disclosure relates to an outdoor unit of an air-conditioning apparatus that includes a soundproof cover of a compressor.

BACKGROUND ART

An outdoor unit of an air-conditioning apparatus includes a compressor, and sound is made from the compressor. Thus, in a certain technique, in order to reduce the sound made from the compressor, the entire compressor is covered with a soundproof cover (see, for example, Patent Literature 1).

CITATION LIST

Patent Literature

Patent Literature 1: Japanese Unexamined Patent Application Publication No. 2017-156038

SUMMARY OF INVENTION

Technical Problem

At an outer surface of a compressor, a terminal unit is provided to electrically connect components provided in the compressor and provided outside the compressor. Thus, in the case where the entire compressor is covered with a soundproof cover as in Patent Literature 1, the terminal unit is also covered with the soundproof cover. In such a manner, in the case where the soundproof cover covers the terminal unit, cables are not efficiently connected to the terminal unit.

The present disclosure is applied to solve the above problem, and relates to an outdoor unit of an air-conditioning apparatus, in which a compressor is soundproofed without causing the workability of connecting cables to a terminal unit to be decreased.

Solution to Problem

An outdoor unit of an air-conditioning apparatus according to an embodiment of the present disclosure includes: a terminal unit that is provided on an outer peripheral surface of a compressor, and electrically connects components provided in the compressor and outside the compressor; a side soundproof cover that covers the outer peripheral surface of the compressor except for the terminal unit; and a terminal cover that covers the terminal unit exposed from the side soundproof cover to the outside of the side soundproof cover, and soundproofs the terminal unit. The terminal cover is attached to the side soundproof cover such that the state of the terminal cover can be changed between a state in which the terminal cover covers the terminal unit and a state in which the terminal cover does not cover the terminal unit.

Advantageous Effects of Invention

According to the embodiment of the present disclosure, the outer surface of the compressor is covered with the side soundproof cover except for the terminal unit, and the terminal unit exposed from the side soundproof cover is covered and soundproofed by the terminal cover. It is therefore possible to achieve sound insulation and sound absorption against leakage of sound from the compressor and the terminal unit.

Furthermore, the terminal cover is attached to the side soundproof cover such that the state of the terminal cover can be changed between a state in which the terminal cover covers the terminal unit and a state in which the terminal cover does not cover the terminal unit. It is therefore possible to prevent the workability of connecting cables to the terminal unit from being decreased.

DESCRIPTION OF EMBODIMENTS

Embodiment 1

An outdoor unit of an air-conditioning apparatus according to Embodiment 1 of the present disclosure will be described with reference to FIGS. 1 to 7.

Figure 1:
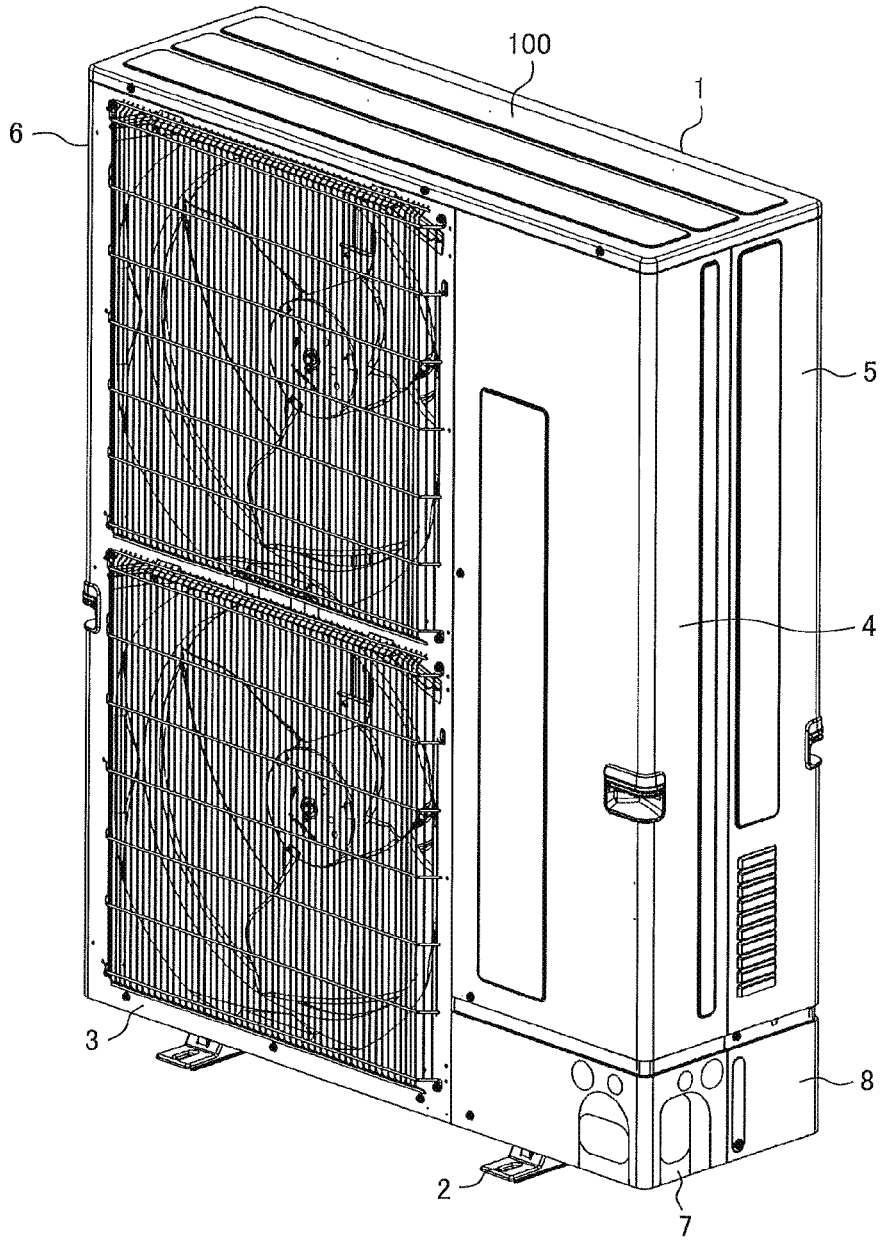
FIG. 1 is a front perspective view of an outdoor unit of an air-conditioning apparatus according to Embodiment 1 of the present disclosure.

FIG. 1 is a front perspective view of the outdoor unit of an air-conditioning apparatus according to Embodiment 1 of the present disclosure. In the following description, "front", "back", "right", "left", "front side", and "back side" of the outdoor unit are respective sides of the outdoor unit as viewed head-on from a front-panel side as illustrated in FIG. 1.

As illustrated in FIG. 1, a housing of an outdoor unit 100 of the air-conditioning apparatus includes: a top panel 1 on the top side of the housing; a base 2 on the bottom side of the housing; a front panel 3 and a service panel 4 on the front side of the housing; a right-side panel 5 on the right side of the housing; a left-side panel 6 on the left side of the housing; and a cover panel 7 and a cover panel 8.

Figure 2:
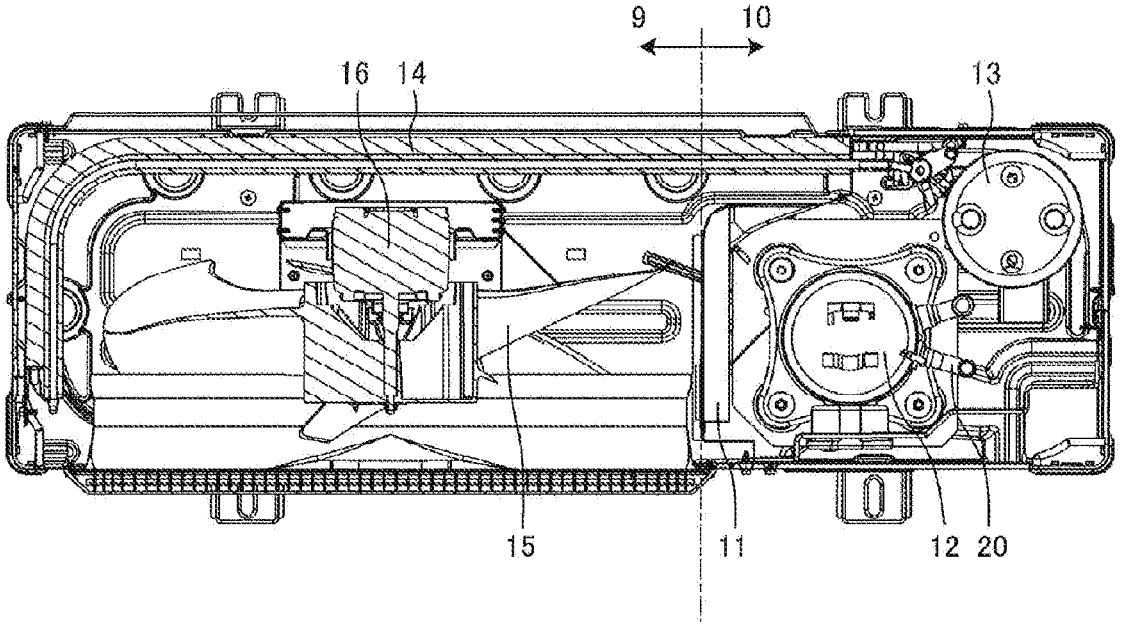
FIG. 2 is a plan view of the outdoor unit of an air-conditioning apparatus according to Embodiment 1 of the present disclosure, and illustrating the outdoor unit, with a top panel and an electronic component box removed from the outdoor unit.

FIG. 2 is a plan view of the outdoor unit of the air-conditioning apparatus according to Embodiment 1 of the present disclosure, with the top panel and an electronic component box removed from the outdoor unit.

The inside of the housing of the outdoor unit 100 is partitioned by a separator 11 into a fan compartment 9 on the left side of the housing and a machine compartment 10 on the right side of the housing. In the machine compartment 10, a compressor 12, refrigerant pipes 20, an electronic component box (not illustrated), and a pressure vessel 13 are provided. In the fan compartment 9, a fan 15, a fan motor 16, and a motor support (not illustrated) that fixes the fan motor 16 are provided. On a back side of the housing of the outdoor unit 100, an L-shaped heat exchanger 14 is provided. In the electronic component box (not illustrated), a control board is provided, and for example, power is supplied from the control board to each of components.

Refrigerant send from an indoor unit (not illustrated) to the outdoor unit 100 is compressed by the compressor 12 and passes through the refrigerant pipes. Then, after sent to the heat exchanger 14, the refrigerant is made to flow to the outside of the outdoor unit 100.

Figure 3:
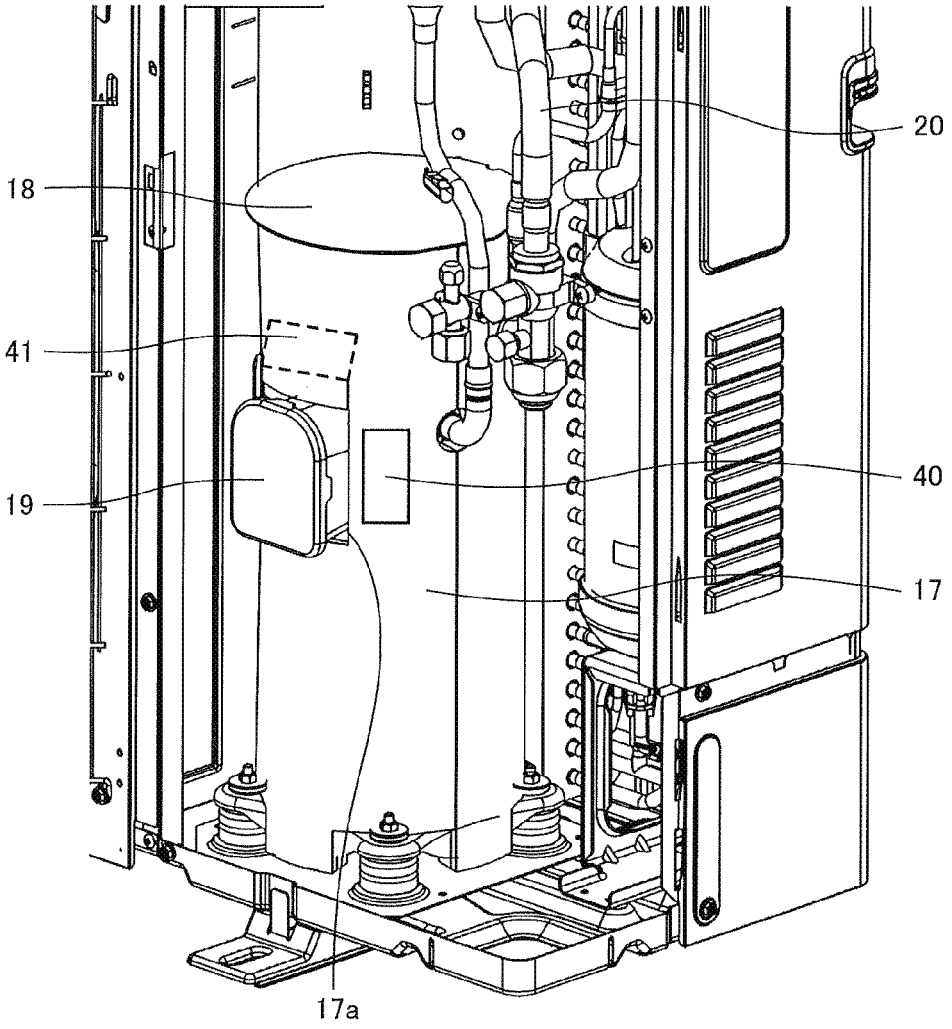
FIG. 3 is a perspective view of the inside of a machine compartment of the outdoor unit of an air-conditioning apparatus according to Embodiment 1 of the present disclosure.
Figure 4:
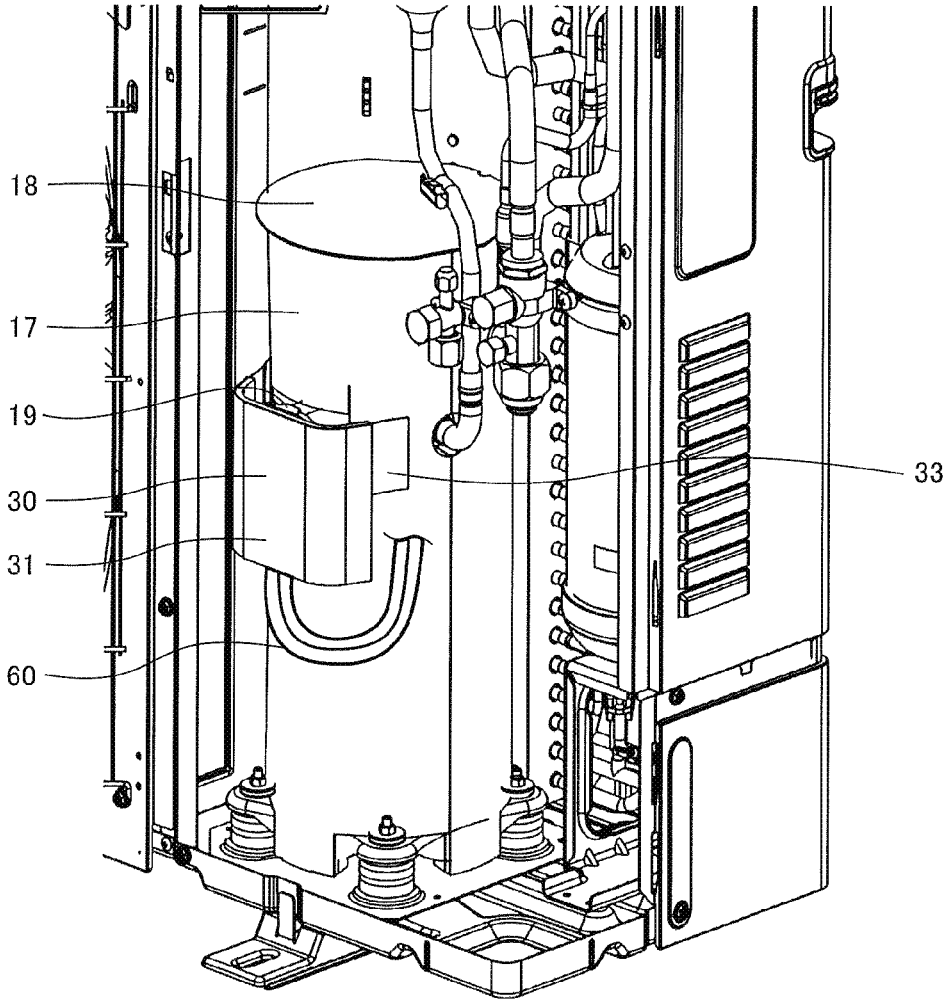
FIG. 4 is a perspective view of the inside of the machine compartment of the outdoor unit of an air-conditioning apparatus according to Embodiment 1 of the present disclosure.

FIG. 3 is a perspective view of the inside of the machine compartment of the outdoor unit of the air-conditioning apparatus according to Embodiment 1 of the present disclosure. FIG. 4 is a perspective view of the inside of the machine compartment of the outdoor unit of the air-conditioning apparatus according to Embodiment 1 of the present disclosure, and illustrates the inside of the machine compartment, with a terminal cover attached to the compressor.

An outer peripheral surface of the compressor 12 is covered with a side soundproof cover 17, and the top of the compressor 12 is covered with a top soundproof cover 18, to thereby reduce a sound leakage to the outside of the compressor 12. Also, at the outer peripheral surface of the compressor 12, a terminal unit 19 is provided to electrically connect components provided in the compressor 12 and provided outside the compressor 12. The terminal unit 19 includes a terminal (not illustrated) that extends through the inside of the compressor 12 to the outside of the compressor 12. One end of the terminal that is located in the compressor 12 is connected to a motor (not illustrated) provided in a vessel that forms a main body of the compressor 12, and another end of the terminal that is located outside the compressor 12 is connected to the electronic component box (not illustrated).

The following description is made by referring to by way of example the case where the compressor 12 is a scroll compressor. The scroll compressor includes a motor (not illustrated) located in a lower portion of the vessel. Thus, in order to shorten part of the cables that is located in the vessel, the terminal unit 19 is located on a side surface of the vessel, not the top of the vessel. The refrigerant pipes 20 are provided to extend to an upper region located above the compressor 12.

In the side soundproof cover 17, an opening 17*a* is formed in an area corresponding to the position of the terminal unit 19. The terminal unit 19 is exposed from the side soundproof cover 17 to the outside thereof through the opening 17*a*. The terminal unit 19 exposed to the outside through the opening 17*a* of the side soundproof cover 17 is covered with a terminal cover 30. The side soundproof cover 17 includes engagement members 40, which are engaged with respective engagement members 33 provided at the terminal cover 30. By the engagement members 40 and the engagement members 33, the terminal cover 30 is detachably attached to the side soundproof cover 17. It should be noted that part 41 indicated by a dotted line in FIG. 3 is also an engagement member, and this engagement member 41 will be described later.

The engagement members 40 and the engagement members 33 are provided as hook and loop fasteners. In this case, each of the engagement members 40 of the side soundproof cover 17 is a loop surface fastener, and each of the engagement members 33 of the terminal cover 30 is a hook surface fastener; however, each engagement member 40 and each engagement member 33 may be a hook surface fastener and a loop surface fastener, respectively. The engagement members 40 and the engagement members 33 are not limited to the hook and loop fasteners, and may have any other structure as long as they can cause the terminal cover 30 to be detachably attached to the side soundproof cover 17.

Figure 5:
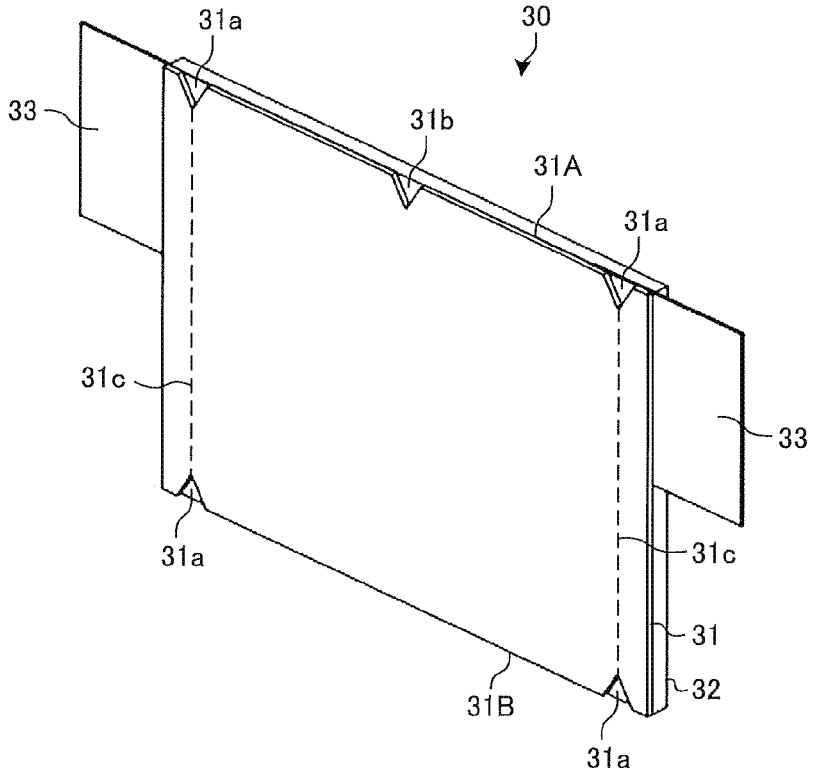
FIG. 5 is a perspective view of a terminal cover that is in an unfolded state before attachment of the terminal cover to a terminal unit as illustrated in FIG. 4.
Figure 6:
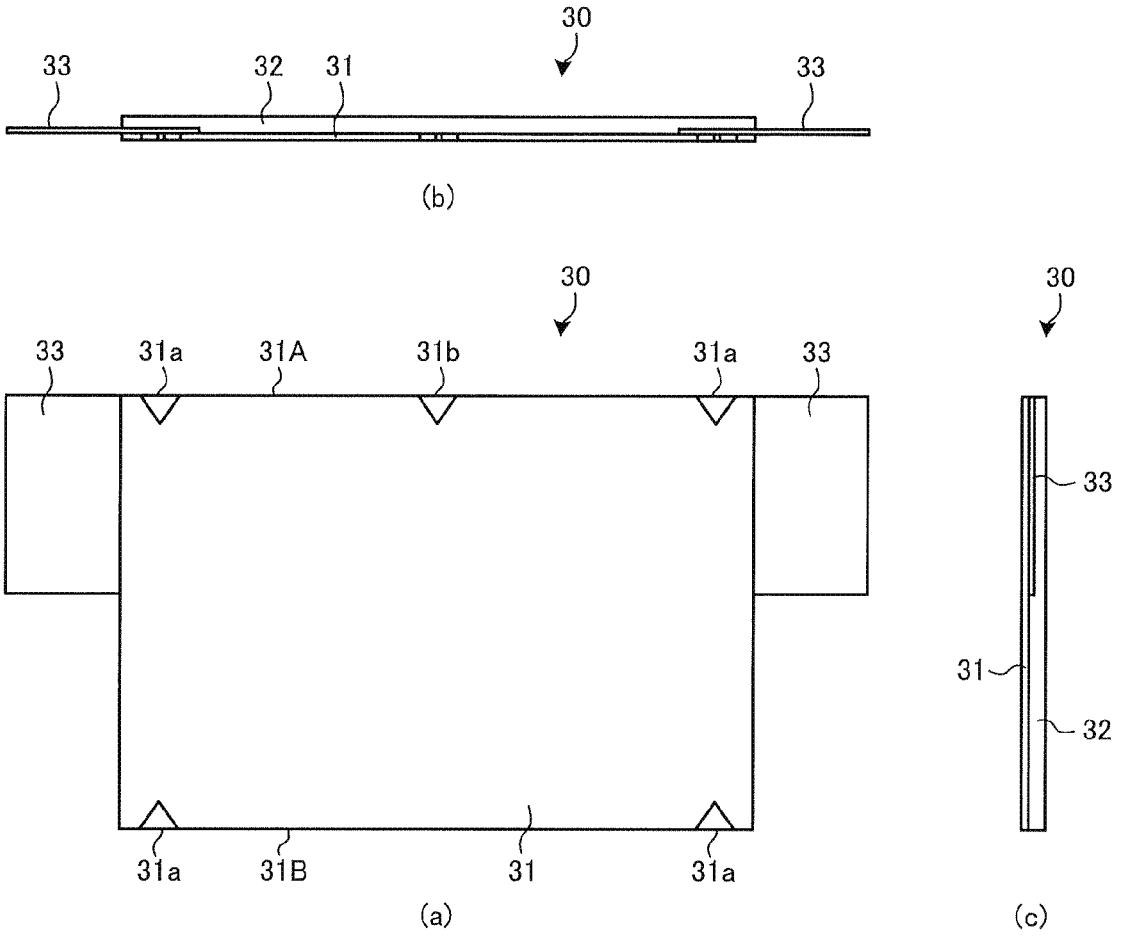
FIG. 6 includes a front view, a plan view, a right side view of the terminal cover as illustrated in FIG. 5.

FIG. 5 is a perspective view of the terminal cover that is in an unfolded state before attachment of the terminal cover to the terminal unit as illustrated in FIG. 4. FIG. 6 includes a front view, a plan view, and a right side view of the terminal cover as illustrated in FIG. 5.

The terminal cover 30 includes a rectangular sound insulating member 31, a sound absorbing member 32 that has substantially the same shape as the sound insulating member 31, and the engagement members 33 that are interposed between the sound insulating member 31 and the sound absorbing member 32 such that the engagement members 33 extend outwardly from left and right edges of the sound insulating member 31 and the sound absorbing member 32. The sound insulating member 31 and the sound absorbing member 32 are deformable sheeted members.

When being in an unfolded state before the sound insulating member 31 and the sound absorbing member 32 are attached to the side soundproof cover 17, the sound insulating member 31 and the sound absorbing member 32 are flat as illustrated in FIG. 5.

The sound insulating member 31 is made of, for example, rubber material for sound insulation. The sound absorbing member 32 is made of, for example, felt material for sound absorption. As described above, the engagement members 33 are each a hook surface fastener. The engagement members 33, the sound insulating member 31, and the sound absorbing member 32 are sewed and united. Reference sign 31*c* in FIG. 5 denotes each of sewn portions. The sewn portions 31*c* as illustrated in FIG. 5 are an example of the sewing.

Each of the engagement members 33 includes multiple hooks (not illustrated) on its back side. The hooks are brought into contact with loops (not illustrated) of an associated one of the engagement members 40 of the side soundproof cover 17, whereby the terminal cover 30 is attached to the side soundproof cover 17.

At outer edges of the sound insulating member 31, notches 31*a* are formed to serve as marks for sewing. To be more specific, in left and right portions of each of an upper edge 31A and a lower edge 31B of the sound insulating member 31, respective notches 31*a* are formed. Of the notches 31*a*, notches 31*a* formed in the upper edge 31A and the lower edge 31B on the left side are provided as a pair of notches 31*a*, and notches 31*a* formed in the upper edge 31A and the lower edge 31B on the right side are provided as another pair of notches 31*a*. Because of this configuration, the sewing can be performed by referring to an imaginary line that connects the notches 31*a* of each of the pairs. Thus, the workability of the sewing can be improved.

Furthermore, at a center portion of the upper edge 31A of the sound insulating member 31 in a lateral direction thereof, a notch 31*b* is formed to serve as a mark at the time of attaching the terminal cover 30 to the side soundproof cover 17. The terminal cover 30 can be attached to the side soundproof cover 17 at a proper position where the terminal cover 30 covers the terminal unit 19, by locating the notch 31*b* at a center portion of the terminal unit 19 in a lateral direction thereof. That is, the notch 31*b* serves as a mark which an operator can refer to at the time of attaching the terminal cover 30 to the side soundproof cover 17 with reference to the above center portions. Because of this configuration, it is possible reduce variations in attachment of terminal covers 30 to side soundproof covers 17.

Cables 60 (see FIG. 4) extended from the outside of the compressor 12 are connected to the terminal unit 19 from a lower side of the terminal unit 19. Thus, the engagement members 40 of the side soundproof cover 17 are provided leftward and rightward adjacent to the terminal unit 19, and with the terminal cover 30 attached to the side soundproof cover 17, the lower side of the terminal unit 19 is kept open as illustrated in FIG. 4. It should be noted that the cables 60 as illustrated in FIG. 4 are extended toward the electronic component box (not illustrated) provided in an upper portion of the housing of the outdoor unit 100.

It will be described how to attach the side soundproof cover 17 and the terminal cover 30.

The side soundproof cover 17 is flat when being in an unfolded state before attachment of the side soundproof cover 17 to the compressor 12, and is wound around a side surface of compressor 12 such that the terminal unit 19 is exposed through the opening 17*a*. A structure for fixing end portions of the side soundproof cover 17 is not limited to a specific one. For example, a hook and loop fastener may be applied as the structure for fixing the end portions of the side soundproof cover 17. The top soundproof cover 18 is attached to a top of the side soundproof cover 17.

The terminal cover 30 is attached to the side soundproof cover 17 attached to the compressor 12. In such a manner, the terminal unit 19 exposed from the opening 17*a* of the side soundproof cover 17 is covered with the terminal cover 30, whereby sound that leaks from the terminal unit 19 can be reduced.

It should be noted that the terminal cover 30 is attached to the side soundproof cover 17 such that the sound insulating member 31 is located on the outer side of the terminal cover 30 and the sound absorbing member 32 is located on the inner side of the terminal cover 30. The sound insulating member 31 is made of rubber material that is hydrophobic or water-repellent. Thus, since the terminal cover 30 is attached such that the sound insulating member 31 is located on the outer side of the terminal cover 30, it is possible to obtain the following advantages. In the case where condensation water generates on the surface of part of the refrigerant pipes that is located above the compressor 12, when dripping down, the condensation water can be repelled by the sound insulating member 31. It is therefore possible to prevent the water from touching the compressor 12, and reduce formation of rust on the compressor 12.

Furthermore, it should be noted that in the case of connecting the cables 60 to the terminal unit 19 from the outside thereof, the terminal cover 30 is detached from the side soundproof cover 17 to expose the terminal unit 19. Thus, in this state, the cables 60 can be connected to the terminal unit 19.

As described above, according to Embodiment 1, the side soundproof cover 17 covers the outer peripheral surface of the compressor 12 except for the terminal unit 19, and the terminal cover 30 covers the terminal unit 19 exposed from the side soundproof cover 17. The terminal cover 30 is detachably attached to the side soundproof cover 17. That is, the terminal cover 30 can be attached to the side soundproof cover 17 to cover the terminal unit 19 and be detached from the side soundproof cover 17 to expose the terminal unit 19. Therefore, since the terminal cover 30 can be detached from the side soundproof cover 17, the cables can be easily connected to the terminal unit 19, while the compressor 12 is soundproofed by the side soundproof cover 17 and the terminal cover 30. That is, it is possible to soundproof the compressor 12 and at the same time prevent the workability of connection of the cables from being decreased.

Furthermore, since the terminal cover 30 is detachably attached to the side soundproof cover 17, it is possible to further obtain the following advantage. In the case where it is necessary to dispose of the terminal cover 30, since the terminal cover 30 can be easily detached from the side soundproof cover 17, the terminal cover 30 can be separated from other components to be disposed of. This is environmentally friendly.

The terminal cover 30 includes the sound insulating member 31 for sound insulation and the sound absorbing member 32 for sound absorption, and can achieve both sound insulation and sound absorption.

The sound insulating member 31 and the sound absorbing member 32 of the terminal cover 30 are put on each other and united. The sound insulating member 31 is made of a hydrophobic or water-repellent material, and the terminal cover 30 is attached to the side soundproof cover 17 such that the sound insulating member 31 is located on the outer side of the terminal cover 30. Therefore, in the case where condensation water generates on the surface of part of the refrigerant pipes 20 that is located above the compressor 12, when dripping down, the condensation water can be repelled by the sound insulating member 31. It is therefore possible to prevent the water from touching the compressor 12, and reduce formation of rust on the compressor 12.

Each of the sound insulating member 31 and the sound absorbing member 32 of the terminal cover 30 is a deformable sheeted member, and can be made to have a rectangular shape or a rectangular shape with a protrusion as the entire exterior of the terminal cover 30 when being in an unfolded state before attachment of the terminal cover 30 to the side soundproof cover 17.

At the central portion of the sound insulating member 1 in the lateral direction thereof, that is, in a circumferential direction of the compressor 12, the notch 31*b* is formed to serve as a mark at the time of attaching the terminal cover 30 to the side soundproof cover 17. Thus, the terminal cover 30 can be attached to the side soundproof cover 17 at a proper position where the terminal cover 30 covers the terminal unit 19, by positioning the notch 31*b* at the central portion of the terminal unit 19 in the lateral direction thereof.

At the outer edges of the sound insulating member 31, the notches 31*a* are formed to serve as marks to be referred to at the time of forming the sewn portions 31*c* such that the notches 31*a* are provided as a plurality of pairs of notches 31*a*. The sewing can thus be performed by referring to the lines each of which connects associated two notches 31*a*, that is, the notches 31*a* of an associated one of the above notch pairs that serve as the marks, thus improving the workability of the sewing.

The configuration of the terminal cover 30 is not limited to that as illustrated in the figures, and can be variously modified within the scope of the embodiment of the present disclosure, and can be modified by way of example as follows.

Figure 7:
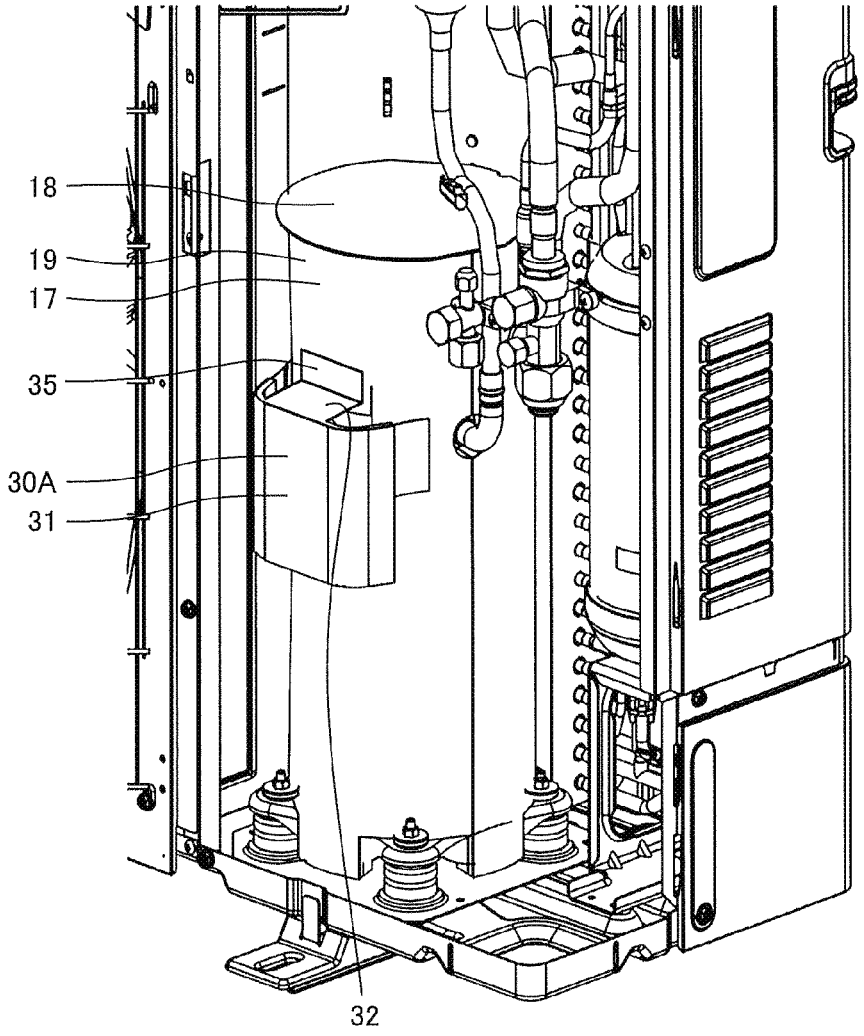
FIG. 7 illustrate a modification of the terminal cover of the outdoor unit of an air-conditioning apparatus according to Embodiment 1 of the present disclosure.

FIG. 7 illustrates a modification of the terminal cover of the outdoor unit of an air-conditioning apparatus according to Embodiment 1 of the present disclosure.

The terminal cover 30 as illustrated in FIG. 6 includes the sound insulating member 31 and the sound absorbing member 32 that are rectangular when the terminal cover 30 is in an unfolded state before the attachment of the terminal cover 30. In contrast, a terminal cover 30A of the modification as illustrated in FIG. 7 includes the sound insulating member 31 and the sound absorbing member 32 that have a rectangular shape with a protrusion when the terminal cover 30A is in an unfolded state before the attachment of the terminal cover 30A. Furthermore, the terminal cover 30A includes an engagement member 35 that extends upwards from an upper edge of the sound insulating member 31 and the sound absorbing member 32 that has the rectangular shape with the protrusion. In the case of using the terminal cover 30 configured in the above manner, an engagement member 41 is provided above the opening 17*a*, as indicated by a dotted line in FIG. 3. In such a manner, since the terminal cover 30 is fixed to the side soundproof cover 17 at three points, it is possible to not only further reduce a sound leak from the terminal unit 19, but more firmly fix the terminal cover 30 to the side soundproof cover 17. Regarding the configuration of the engagement member 35 and the engagement member 41, it suffices that the engagement member 35 and the engagement member 41 are formed, for example, as a hook and loop fastener, as well as the above engagement member 33 and the engagement member 40.

It is described above that the terminal cover 30 and the terminal cover 30A each have a rectangular shape or a rectangular shape with a protrusion. However, the shapes of the terminal cover 30 and the terminal cover 30A are not limited to such shapes. The terminal cover 30 and the terminal cover 30A may be arbitrary shaped as long as they can be made to cover the terminal unit 19 such that they can achieve sound insulation and sound absorption against leakage of sound from the terminal unit 19.

Embodiment 2

Embodiment 2 is different from Embodiment 1 in the structure for attaching the terminal cover to the side soundproof cover 17. Embodiment 2 will be described by referring mainly to the differences between Embodiments 1 and 2, and the components of Embodiment 2 that are the same as those of Embodiment 1 will not be described. Furthermore, the above modification of components in Embodiment 1 is also applicable as that of components in Embodiment 2 that are the same as or similar to the components in Embodiment 1.

Figure 8:
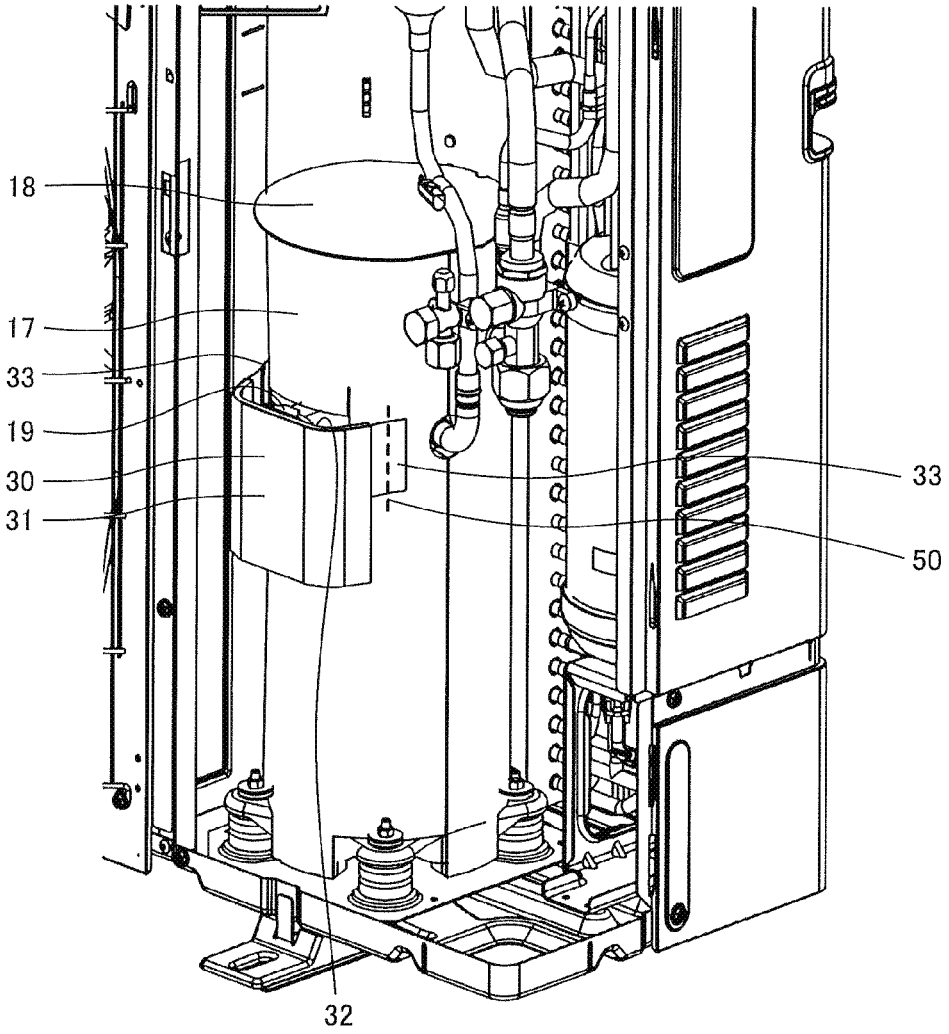
FIG. 8 is a perspective view of the inside of a machine compartment of an outdoor unit of an air-conditioning apparatus according to Embodiment 2 of the present disclosure.

FIG. 8 is a perspective view illustrating the inside of the machine compartment of the outdoor unit of an air-conditioning apparatus according to Embodiment 2 of the present disclosure, with the terminal cover attached to the compressor.

In Embodiment 2, the terminal cover 30 that is the same as the terminal cover 30 of Embodiment 1 is fixed to the side soundproof cover 17. More specifically, the right engagement member 33 of the terminal cover 30 is sewn and fixed to the side soundproof cover 17, as illustrated in FIG. 8. It should be noted that reference sign 50 in FIG. 8 denotes a sewn portion. In such a manner, the terminal cover 30 is fixed to the side soundproof cover 17 only by the sewn portion 50. Therefore, the state of the terminal cover 30 can be changed between a state in which the terminal cover 30 covers the terminal unit 19 and a state in which the terminal cover 30 does not cover the terminal unit 19.

Since the terminal cover 30 is fixed to the side soundproof cover 17, the terminal cover 30 is attached together with the side soundproof cover 17 to the compressor 12. To cover the terminal unit 19 exposed through the opening 17*a* of the side soundproof cover 17, the left engagement member 33 of the terminal cover 30 is brought into contact with and attached to an engagement member (not illustrated) provided leftward adjacent to the opening 17*a* of the side soundproof cover 17.

In the case of connecting the cables 60 to the terminal unit 19 from the outside of the terminal unit 19, the left engagement member 33 of the terminal cover 30 is disengaged from the side soundproof cover 17. Thus, the above connection of the cables 60 can be achieved, with the terminal cover 30 located not to cover the terminal unit 19; that is, with the terminal cover 30 exposed.

As described above, according to Embodiment 2, it is possible to not only obtain the same advantages as in Embodiment 1, but obtain the following advantages because of fixation of the terminal cover 30 to the side soundproof cover 17. The terminal cover 30 does not easily fall off. Furthermore, it is possible to reduce variations in attachment of terminal covers 30.

In order to fix the terminal cover 30 to the side soundproof cover 17, if both the left and right engagement members 33 of the terminal cover 30 are fixed to the side soundproof cover 17, the workability of connecting the cables 60 to the terminal unit 19 from the outside thereof is worsened. By contrast, in Embodiment 2, the terminal cover 30 is fixed to the side soundproof cover 17 such that the state of the terminal cover 30 can be changed between the state in which the terminal cover 30 covers the terminal unit 19 and the state in which the terminal cover 30 does not cover the terminal unit 19. The workability of connection of the cables 60 is improved.

In order to enable the state of the terminal cover 30 to be changed between the above states, it suffices that one of the engagement members 33 of the terminal cover 30 is fixed to the side soundproof cover 17.

Referring to FIG. 8, the right engagement member 33 is sewn to the side soundproof cover 17. However, the left engagement member 33 may be sewn to the side soundproof cover 17. That is, it suffices that the terminal cover 30 is configured such that one of two opposite edge portions of the terminal cover 30 is fixed to the side soundproof cover 17, and the other edge portion is not fixed to the side soundproof cover 17 and includes the engagement member 33 as the engagement member of the terminal cover 30. In the case where the terminal cover 30 is configured as in the modification as illustrated in FIG. 7, the upper engagement member 35 may be sewn to the side soundproof cover 17.

Referring to FIG. 8, the engagement members 33 of the terminal cover 30 are sewn to the side soundproof cover 17. However, the engagement members 33 may be omitted, and the sound insulating member 31 and the sound absorbing member 32 may be sewn together directly to the side soundproof cover 17.

REFERENCE SIGNS LIST

1 top panel, 2 base, 3 front panel, 4 service panel, 5 right-side panel, 6 left-side panel, 7 cover panel, 8 cover panel, 9 fan compartment, 10 machine compartment, 11 separator, 12 compressor, 13 pressure vessel, 14 heat exchanger, 15 fan, 16 fan motor, 17 side soundproof cover, 17*a* opening, 18 top soundproof cover, 19 terminal unit, 20 refrigerant pipe, 30 terminal cover, 30A terminal cover, 31 sound insulating member, 31A upper edge, 31B lower edge, 31*a* notch, 31*b* notch, 31*c* sewn portion, 32 sound absorbing member, 33 engagement member, 35 engagement member, 40 engagement member, 41 engagement member, 50 sewn portion, 60 cable, 100 outdoor unit

The invention claimed is:

1. An outdoor unit of an air-conditioning apparatus, comprising:

a terminal provided on an outer peripheral surface of a compressor, and configured to electrically connect components provided in the compressor and outside the compressor;

a side soundproof cover configured to cover the outer peripheral surface of the compressor except for the terminal; and a terminal cover configured to cover the terminal exposed from the side soundproof cover to the outside of the side soundproof cover and to soundproof the terminal, wherein at least a part of the terminal cover is detachably attached to the side soundproof cover so that the terminal cover is configured to be changed between a state in which the terminal cover covers the terminal and a state in which the terminal cover does not cover the terminal, wherein the terminal cover and the side soundproof cover include respective fasteners configured to be engaged with each other, wherein the terminal cover includes a sound insulating sheet configured to prevent passage of sound, a sound absorbing sheet configured to absorb sound, and sewn portions that are formed to unite the sound insulating sheet, the sound absorbing sheet, and the fasteners of the terminal cover, and wherein each of the sound insulating sheet and the sound absorbing sheet of the terminal cover is a deformable sheet and has a rectangular shape when in an unfolded state before attachment of the terminal cover to the side soundproof cover.

2. The outdoor unit of an air-conditioning apparatus of claim 1, wherein the sound insulating sheet and the sound absorbing sheet of the terminal cover are put on each other and united, the sound insulating sheet is formed of a hydrophobic or water-repellent material, and the terminal cover is attached to the side soundproof cover such that the sound insulating sheet is located on an outer side of the terminal cover.

3. The outdoor unit of an air-conditioning apparatus of claim 1, wherein the sound insulating sheet has a notch that is formed at a center portion of the sound insulating member in a circumferential direction of the compressor, and the notch is configured to serve as a mark with reference to which the terminal cover is attached to the side soundproof cover at a proper position where the terminal cover covers the terminal.

4. The outdoor unit of an air-conditioning apparatus of claim 1, wherein the terminal cover is detachably attached to the side soundproof cover by the fastener of the terminal cover so that the terminal cover is entirely removable from the side soundproof cover.

5. The outdoor unit of an air-conditioning apparatus of claim 1, wherein the fasteners of the terminal cover and the side soundproof cover include a hook and loop fastener.

6. The outdoor unit of an air-conditioning apparatus of claim 1, wherein the sound insulating sheet includes a plurality of pairs of notches formed in outer edges of the sound insulating sheet, the notches serving as marks with reference to which the sewn portions are formed, and lines each connecting the notches of an associated one of the plurality of pairs are provided as marks for sewing.

7. The outdoor unit of an air-conditioning apparatus of claim 1, wherein the terminal cover is fixed to the side soundproof cover such that a state of the terminal cover is allowed to be changed between a state in which the terminal cover covers the terminal and a state in which the terminal cover does not cover the terminal.

8. The outdoor unit of an air-conditioning apparatus of claim 7, wherein one of two opposing edges of the terminal cover is fixed to the side soundproof cover and an other of the two opposing edges is not fixed to the side soundproof cover, and the fastener of the terminal cover is provided at the other of the two opposing edges.

* * * * *